US009319775B2

(12) United States Patent
Youn

(10) Patent No.: US 9,319,775 B2
(45) Date of Patent: Apr. 19, 2016

(54) ELECTRONIC APPARATUS, AND METHOD OF PROVIDING OF SOUND

(71) Applicant: Samsung Electronics Co., Ltd, Suwon-si, Gyeonggi-do (KR)

(72) Inventor: Jae-sub Youn, Anyang-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/302,540

(22) Filed: Jun. 12, 2014

(65) Prior Publication Data

US 2015/0036869 A1 Feb. 5, 2015

(30) Foreign Application Priority Data

Aug. 5, 2013 (KR) ..... 10-2013-0092542

(51) Int. Cl.
*H04R 1/00* (2006.01)
*H04R 1/02* (2006.01)
*H04R 1/32* (2006.01)

(52) U.S. Cl.
CPC ..... *H04R 1/323* (2013.01); *H04R 1/028* (2013.01); *H04R 2499/15* (2013.01)

(58) Field of Classification Search
CPC ..... H04R 1/028; H04R 1/323; H04R 2499/15
USPC ..... 381/412
See application file for complete search history.

(56) References Cited

U.S. PATENT DOCUMENTS

| | | | | |
|---|---|---|---|---|
| 5,838,537 | A * | 11/1998 | Lundgren et al. | 361/679.27 |
| 6,243,260 | B1 * | 6/2001 | Lundgren et al. | 361/679.23 |
| 7,650,003 | B1 * | 1/2010 | Hines | 381/152 |
| 2002/0141164 | A1 * | 10/2002 | Watanabe et al. | 361/749 |
| 2005/0069159 | A1 * | 3/2005 | Nakazato | 381/306 |
| 2005/0185376 | A1 * | 8/2005 | Sawyer | 361/687 |
| 2010/0054521 | A1 * | 3/2010 | Hung et al. | 381/386 |
| 2012/0076330 | A1 * | 3/2012 | Cohen et al. | 381/191 |
| 2012/0235636 | A1 * | 9/2012 | Partovi | 320/108 |
| 2013/0236337 | A1 * | 9/2013 | Gummin et al. | 417/412 |
| 2014/0218332 | A1 * | 8/2014 | Yu | 345/174 |

* cited by examiner

*Primary Examiner* — Khai N Nguyen
(74) *Attorney, Agent, or Firm* — Staas & Halsey LLP

(57) ABSTRACT

An electronic apparatus includes a configured to output audio using a permanent magnet, an audio processor configured to process audio data and output to the speaker, and an electromagnet configured to push the permanent magnet and project the speaker out on the electronic apparatus, with application of electric current.

19 Claims, 9 Drawing Sheets

ELECTRONIC APPARATUS, AND METHOD OF PROVIDING OF SOUND

CROSS-REFERENCE TO RELATED APPLICATIONS

This application claims priority from Korean Patent Application No. 10-2013-0092542, filed on Aug. 5, 2013, in the Korean Intellectual Property Office, the disclosure of which is incorporated herein by reference in its entirety.

BACKGROUND OF THE INVENTION

1. Field of the Invention

Apparatuses and methods consistent with what is disclosed herein relate to providing of sound, and more specifically, to an electronic apparatus configured to vary a direction of speaker output using an electromagnet and a permanent magnet provided on the speaker, and a method of providing sound.

2. Description of the Related Art

A laptop refers to a portable, small-size computer for individual's mobile use. Recently, the portable computers like slate PCs or tablet PCs have been introduced with further increased mobility by being combined with touchscreens.

The laptop generally includes a speaker for sound output, but the position of the speaker arrangement on the laptop, which is usually influenced by the constraint of the laptop's configuration, has not met user satisfaction. That is, the speaker is generally arranged on a main body where the keypad is also placed, in which case the direction of speaker output is not faced with the user, but the ceiling.

Although the speaker can be arranged in a direction that faces the user, this means that the speaker is continuously projected out of the system, which will then cause problems of design constraint such as increasing a thickness or a width of the system.

Accordingly, a method and apparatus which can provide sound in a way that favors the user is needed.

SUMMARY OF THE INVENTION

Exemplary embodiments of the present inventive concept overcome the above disadvantages and other disadvantages not described above. Also, the present inventive concept is not required to overcome the disadvantages described above, and an exemplary embodiment of the present inventive concept may not be specifically directed to overcoming any of the problems described above.

The present inventive concept provides an electronic apparatus configured to vary a direction of speaker output using an electromagnet and a permanent magnet provided on the speaker, and a sound providing method.

Additional features and utilities of the present general inventive concept will be set forth in part in the description which follows and, in part, will be obvious from the description, or may be learned by practice of the general inventive concept.

Exemplary embodiments of the general inventive concept provide an electronic apparatus, which may include a speaker configured to output audio using a permanent magnet, an audio processor configured to process audio data and output the audio data to the speaker, and an electromagnet configured to push the permanent magnet and project the speaker out of the electronic apparatus, with application of electric current.

The speaker may include a housing in which one side is connected to the electronic apparatus with a hinge, and the other side is at a distance from the electronic apparatus, and a speaker module arranged within the housing, to output the audio using the permanent magnet.

The housing may be buried in the electronic apparatus to a degree of being in a parallel relationship with a surface of the electronic apparatus, when the electric current is not input to the electromagnet.

The electromagnet may be arranged at a position on a circuit board to correspond to the permanent magnet.

The electromagnet may include one of a solenoid and a superconductive magnet.

The circuit board may include a plurality of layers, and the electromagnet comprises a coil pattern of a plurality of layers on the circuit board.

The electromagnet may include an iron core, and the speaker is buried within the electronic apparatus when the electric current is not input to the electromagnet, as the permanent magnet pulls the iron core.

The electronic apparatus may include a plurality of speakers and a plurality of electromagnets corresponding to the plurality of speakers, respectively, and the audio processor may output the audio data to the plurality of speakers.

The electronic apparatus may additionally include a controller configured to individually control whether the plurality of electromagnets is operated.

The electronic apparatus may additionally include a controller configured to control whether the electromagnet is operated.

The controller may be configured to control so that the electromagnets operate upon receiving of a user's control command or driving of a preset program.

The controller may project the speaker to a predetermined height, by allowing electronic current in an amount corresponding to a user set value and a preset condition to flow in the electromagnets.

In another embodiment, a sound providing method of an electronic apparatus including a speaker is provided, which may include processing audio data, outputting the processed audio data to the speaker, and projecting the speaker out of the electronic apparatus, using a system referred to as.

The sound providing method may additionally include pulling, by the permanent magnet, the iron core so as to bury the speaker in the electronic apparatus, in the absence of electric current on the electromagnets.

The electronic apparatus may include a plurality of speakers and a plurality of electromagnets corresponding to the plurality of speakers, respectively, and the outputting may include outputting the audio data to the plurality of speakers.

The projecting may include individually controlling the plurality of electromagnets, and individually projecting the plurality of speakers, respectively.

The projecting may include projecting the speakers out of the electronic apparatus when a user control command is input or when a preset program is driven.

The projecting may include projecting the speakers to a preset height, by allowing electronic current in a size corresponding to a user set value and a preset condition to flow on the electromagnets.

Exemplary embodiments of the general inventive concept also provide an electronic apparatus with a casing, comprising: at least one speaker including a permanent magnet and configured to move between being disposed within the casing and projecting from the casing; and an electromagnet disposed within the casing and configured to create a repulsive force with the permanent magnet to force the speaker to project from the casing when an electric current is applied thereto.

In an exemplary embodiment, the at least one speaker comprises a plurality of speakers each to produce audio sound from a respective audio signal.

In an exemplary embodiment, the electronic further comprises an audio processor to process an audio signal, to separate the processed audio signal and to output the separated signals to the plurality of speakers at corresponding positions.

In an exemplary embodiment, the separated signals are stereo signals which are output to corresponding speakers to create a stereo sound.

In an exemplary embodiment, the casing includes an upper casing and a lower casing, and the plurality of speakers are disposed in the lower casing.

In an exemplary embodiment, the plurality of speakers are distributed about left and right sides of the lower casing and an upper surface of the lower casing.

In an exemplary embodiment, the electronic apparatus further comprises: a controller to sense a position of a user, to determine a degree of projection of the at least one speaker based on the determined position, and to determine an electric current to flow through the electromagnet based on the previous determinations.

BRIEF DESCRIPTION OF THE DRAWINGS

These and/or other features and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
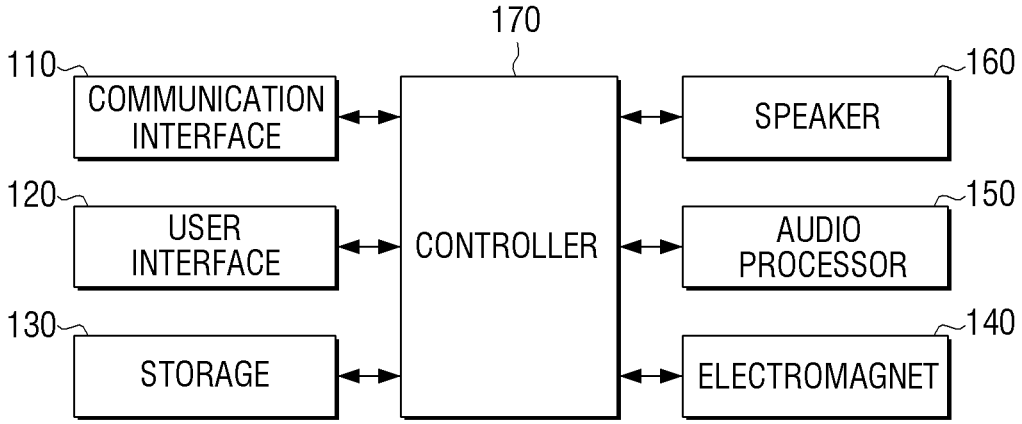
FIG. 1 is a block diagram of an electronic apparatus according to an embodiment.

Certain exemplary embodiments of the present inventive concept will now be described in greater detail with reference to the accompanying drawings.

In the following description, same drawing reference numerals are used for the same elements even in different drawings. The matters defined in the description, such as detailed construction and elements, are provided to assist in a comprehensive understanding of the present inventive concept. Accordingly, it is apparent that the exemplary embodiments of the present inventive concept can be carried out without those specifically defined matters. Also, well-known functions or constructions are not described in detail since they would obscure the invention with unnecessary detail.

FIG. 1 is a block diagram of an electronic apparatus according to an embodiment.

Referring to FIG. 1, the electronic apparatus 100 includes a communication interface 110, a user interface 120, a storage 130, an electromagnet 140, a sound processor 150, a speaker 160, and a controller 170. The electronic apparatus 100 may be a desktop, a laptop, a PMP, a tablet computer, an MP3 player, a portable multimedia player (PMP), or a mobile phone.

The communication interface 110 is provided to connect to at least one external host or internet network, by wired or wireless manner. The communication interface 110 may receive sound content from external devices. The 'contents' as used herein may include sound contents or radio contents that include audio signals only, video contents that include audio signals and video signals, or game contents.

The user interface 120 may receive a variety of functions supported in the electronic apparatus 100, and display a variety of information as provided by the electronic apparatus 100. The user interface 120 may be implemented as a touchscreen to provide both input and output functions on one single device, and may also be implemented as a combined form of input such as a mouse and a keyboard with an output such as an LCD monitor.

The user interface 120 may receive a control command to select the sound data stored at the storage 130 which will be explained in detail below. The user interface 120 may also receive a control command regarding whether the speaker 160 (to be explained below) is projecting outward. That is, the user interface 120 may display a user interface window to receive an indication as to whether the speaker 160 is to project outward, and receive from the displayed user interface a user control command as to whether to project the speaker 160.

Meanwhile, for the electronic apparatus 100 having a plurality of speakers 160, the user interface 120 may receive an indication as to whether the speakers 160 are projecting, either for each of the individual speakers 160 or for all the speakers 160 as a whole. Meanwhile, in an exemplary embodiment, the indication of the user as to whether the speaker (or speakers) 160 is to be projected may be received using a button 121.

Further, the user interface 120 may receive the degree of projection of the speaker 160 (e.g., height or direction of projection). That is, the user interface 120 may display a user interface window to receive a user's indication as to the degree of projecting the speaker 160 and receive information about how much the speaker 160 should be projected, through the displayed user interface window. Meanwhile, for the electronic apparatus 100 having a plurality of speakers 160, the user interface 120 may receive the degree of projection (or angle of projections) of each of the speakers 160. The input information about the degree of projection may be stored at the storage 130 and used as a preset value for later use when the projection is performed.

The storage 130 may store programs to drive the electronic apparatus 100. To be specific, the storage 130 may store a program which is a set of a variety of command languages required to drive the electronic apparatus 100. The 'program' may include not only application programs to provide specific services, but also an operating system to drive the application programs.

The storage 130 may store source data. The 'source data' as used herein may refer to sound source files such as MP3, or WAV, or stream data. Further, the source data may include an audio signal only, or an audio signal and a video signal together. That is, the source data may be video data.

The storage 130 may be implemented as an internal or external storage medium of the electronic apparatus 100 such as a removable disk including USB memory, or web server via the network.

On application of electric currents, the electromagnet 140 pushes the permanent magnet of the speaker, according to which the speaker 160 projects from the electronic apparatus 100. That is, upon application of electric current flow on a conductive wire (see FIG. 3), the electromagnet 140 forms a concentric magnetic field around the conductive wire. Accordingly, the magnetic field is formed upon application of the electric current. When the magnetic field is formed at the electromagnet 140, the field reacts with the magnetic field of the permanent magnet of the speaker, to thus create forces of attraction or repulsion. In one embodiment, in order to generate a repulsive force with the permanent magnet of the speaker, the electromagnet 140 may be arranged at a position corresponding to the permanent magnet to have a repulsive force with the permanent magnet of the speaker. The electromagnet 140 may be a solenoid, or a superconducting magnet.

Figure 7:
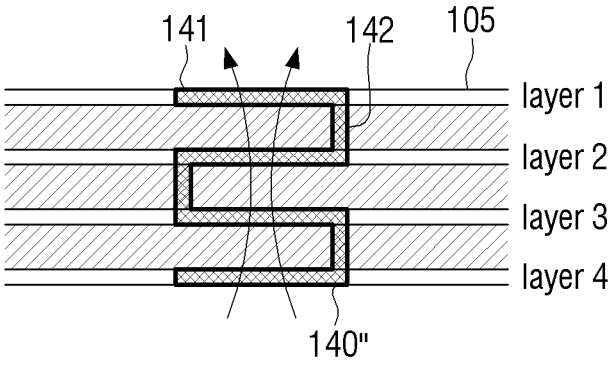
FIG. 7 illustrates an example where an electromagnet is provided on a circuit board.

The solenoid used as the electromagnet 140 may be a device that includes conductive wires densely and uniformly wound in an elongated cylindrical form. Upon application of electric current to the cylindrically-wound coil, an electromagnetic field is formed. A stronger electromagnetic field may be formed, when iron core is placed therein. Considering that the solenoid is one that includes winding of conductive wires, the solenoid may be implemented by forming a coil pattern on a circuit board as illustrated in FIG. 7. The coil pattern will be explained below with reference to FIG. 7.

The superconductive magnet generates a very strong magnetic field at a considerably low temperature at which helium turns to liquid, with the solenoid that includes superconductive wires.

Meanwhile, the electromagnet 140 may include an iron core. Accordingly, absence of electric current along the electromagnet 140 causes attraction to be formed between the permanent magnet of the speaker 160 and the iron core within the electromagnet 140. Accordingly, the speaker 160 is changed from the projected position to a buried position within the electronic apparatus 100.

As explained above, in an embodiment, the electronic apparatus 100 may be so configured that the speaker 160 is buried in the electronic apparatus 100 where there is an absence of electric current along the electromagnet 140. However, other embodiments are also possible. For example, the iron core may not be used, in which case the electric current is flowed to the electromagnet 140 in a direction other than the projecting direction, so that the speaker 160 is buried in the electronic apparatus 100.

The audio processor 150 processes audio data and outputs the result to the speaker 160. That is, the audio processor 150 may process the audio data received via the communication interface 110 or the audio data stored at the storage 130 and output the processed result to the speaker 160 (or speakers).

To be more specific, the audio processor 150 may divide an audio signal, video signal, or the like from the broadcast signal or contents. The audio processor 150 may then transmit the separated audio signal to the user interface 120 and perform signal processing such as audio decoding with respect to the separated audio signal.

The audio processor 150 may separate the processed audio signal into a left-side audio signal and a right-side audio signal, and output the audio signals to a plurality of speakers at corresponding positions. The audio processor 150 may extract a sub-woofer audio signal with respect to the processed audio signal. The 'sub-woofer audio signal' as used herein refers to an audio signal at a low frequency range (e.g., 20 hz to 1.5 KHz) commonly included in both the left- and right-side audio signals.

The speaker 160 outputs the audio data as provided from the audio processor 150. That is, the speaker 160 may be fixed at a predetermined position of the electronic apparatus 100 and project from the electronic apparatus 100 according to control of the controller 170, and in its projected position, output audio data as provided from the audio processor 150. The detailed constitution and operation of the speaker 160 will be explained below in detail with reference to FIG. 2.

The controller 170 controls the respective parts of the electronic apparatus 100. That is, the controller 170 may control the audio processor 150 to output audio corresponding to the contents through the speaker 160, when an audio output command is input by a user or when a content executing command is input.

The controller 170 may determine whether the speaker 160 is projecting outward. That is, the controller 170 may determine that the speaker 160 has to project out, when it is necessary to output audio. The controller 170 may also determine that the speaker 160 has to project out, when it is necessary to output audio in a way of using a media player program such as for MP3 playback or video playback. Further, the controller 170 may determine that the speaker 160 has to project out, upon receiving a user's command to project the speaker 160. Meanwhile, for the electronic apparatus 100 with a plurality of speakers 160, the determination may be made individually for the respective speakers or the determination may be made collectively.

The controller 170 may determine the degree of projecting the speaker 160. That is, the controller 170 may sense the position where the user is located and determine how much the speaker 160 is to project outward, based on such sensed position. The electronic apparatus 100 may include a sensor or a photographer (camera) to sense the position of the user. Alternatively, the controller 170 may use the position of the user or the degree of projecting the speaker which may be input via the user interface 120. Meanwhile, for the electronic apparatus 100 with a plurality of speakers, the determination may be made individually for the respective speakers or the determination may be made collectively.

The controller 170 controls the flow of electric current to the electromagnet 140. To be specific, the controller 170 may determine the electric current flowing to the electromagnet 140 depending on the previously-made determinations, including a determination as to whether the speaker 160 is to be projected, or the degree of projecting the speaker 160. In an exemplary embodiment, the controller 170 may directly provide the electromagnet 140 with electric current as explained above, but is not limited thereto. Accordingly, in another exemplary embodiment, the controller 170 may be so configured to perform the determinations only, while a separate other component may be provided to provide electric current to the electromagnet 140.

In an exemplary embodiment, the electronic apparatus 100 may vary the direction of outputting of the speaker 160, which will thus produce sound in a way the user prefers. Further, since it is possible to vary the direction of outputting of the speaker 160 using only a small-sized electromagnet, i.e., without having to use a relatively large-sized component such as a motor, etc., the size and cost of the system can be reduced. Further, when it is not necessary to output audio, the speaker may be fixed without requiring an additional instrument, i.e., using only the iron core of the electromagnet and permanent magnet of the speaker.

Figure 3:
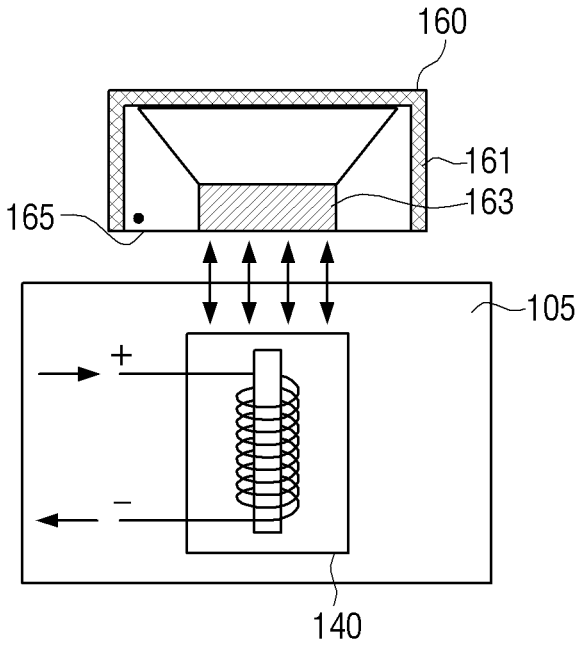
FIG. 3 is a view provided to explain an arrangement position of the speaker.

FIG. 3 illustrates a detailed constitution of the speaker of FIG. 1.

Referring to FIG. 3, the speaker 160 may include a housing 161 and a speaker module 163.

Figure 4:
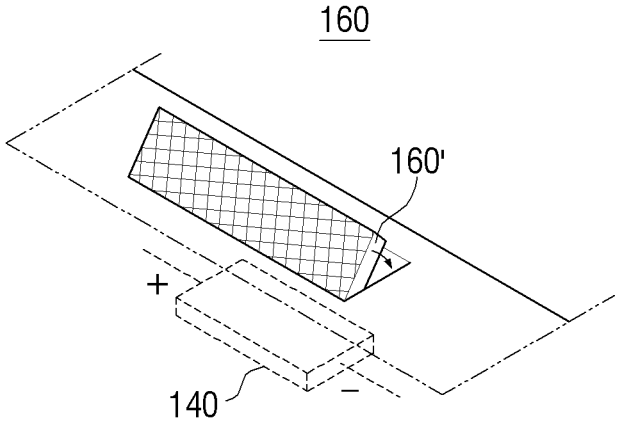
FIGS. 4 to 6 are views provided to explain various configurations of the speaker according to various exemplary embodiments.
Figure 5:
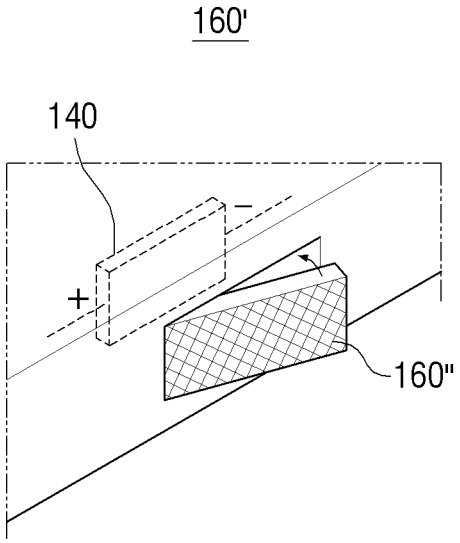
Figure 6:
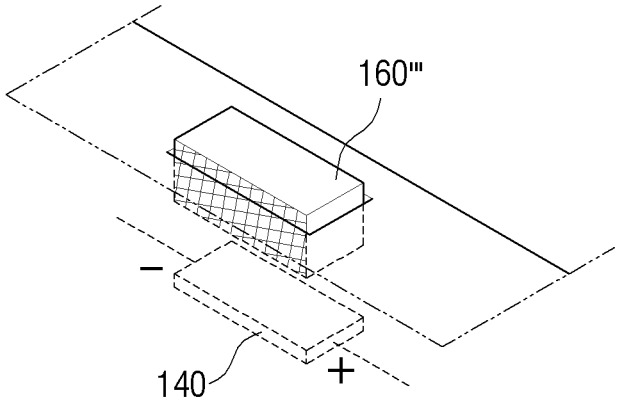

The housing 161 wraps around the speaker module 163. One side of the housing 161 may be connected to a casing of the electronic apparatus 100 with a hinge 165, while the other side may be at a distance from the casing of the electronic apparatus 100. Accordingly, the housing 161 may be buried in the electronic apparatus 100 to the extent of being in a parallel relationship with the surface of the electronic apparatus 100, or may project from the electronic apparatus 100 (FIGS. 4 to 6) depending on the operation of the electromagnet 140. Referring to FIGS. 4 to 6, the housing 161 may have a hexahedral configuration, but the shape of the housing is not limited thereto. Further, in an exemplary embodiment, it is possible to project the speaker 160 from the electronic apparatus 100 using a hinge, but the projecting of the speaker is not limited thereto. Accordingly, in another exemplary embodiment, the speaker 160 may project from the electronic apparatus using another type of coupling device, such as, for example, a slide.

The speaker module 163 is arranged inside the housing 161 and outputs audio using a permanent magnet. To be specific, the speaker module 163 operates to convert an electric signal into vibration of a vibrating plate, to thus generate a wave of condensation and rarefaction in air and radiate a sound wave. In an exemplary embodiment, any speaker that has a permanent magnet is applicable as the speaker module.

Referring to FIG. 3, the electromagnet 140 may be arranged on a circuit board 105 that corresponds to the permanent magnet of the speaker 160. In one embodiment, when the + pole of the permanent magnet of the speaker is adjacent to the electromagnet, the direction of electric current of the electromagnet may be so set that the + polarity is generated at the portion of the electromagnet adjacent to the plane of the permanent magnet of the speaker. On the contrary, the electric current may be oriented oppositely, when the plane of the permanent magnet is the – pole.

The circuit board 105 may be a printed circuit board (PCB) on which circuit components of the electronic apparatus 100 including the communication interface 110, the electromagnet 140, the audio processor 150 or the controller 170, are mounted. In another exemplary embodiment, the circuit board 105 may be a devoted circuit board on which only the electromagnet 140 is arranged.

Figure 2:
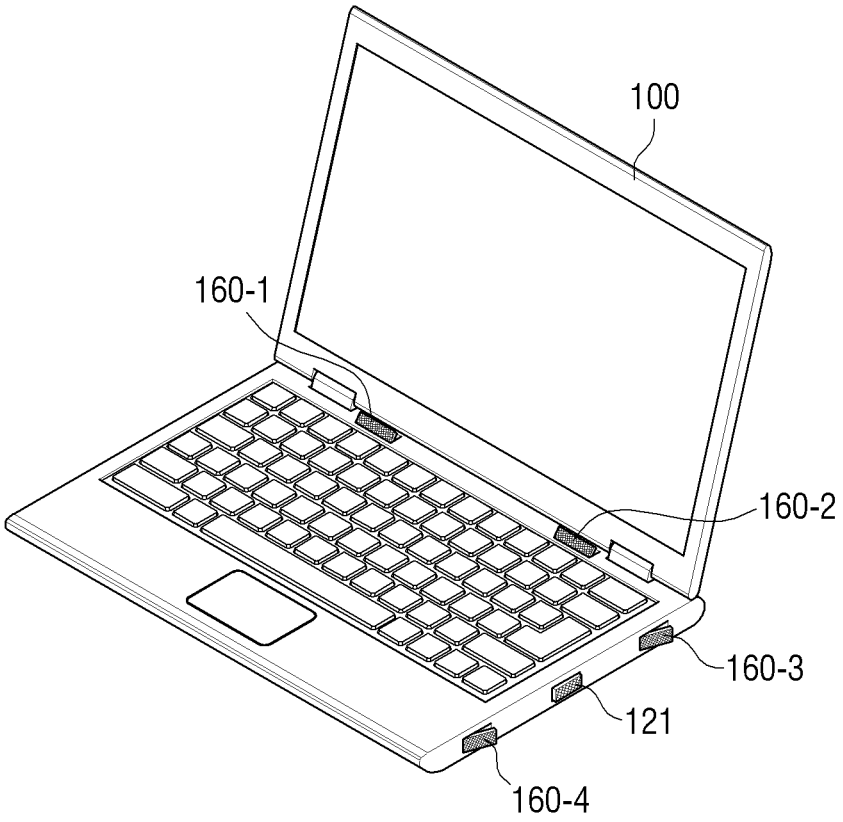
FIG. 2 illustrates a constitution of the speaker of FIG. 1 in detail.

FIG. 2 is a view provided to explain an exemplary position where the speaker is arranged.

Referring to FIG. 2, two casings surround the electronic apparatus. The casings may include an upper casing (or first casing) to protect the display device, and a lower casing (or second casing) to protect the input device.

Considering that the presence of the display device limits a space in the upper casing, the speaker 160 is generally arranged in the lower casing. However, although the speaker may be arranged in the lower casing, positioning of the speaker is not limited thereto. Accordingly, in another exemplary embodiment, the speaker may be arranged in the upper casing. Further, although the illustrated embodiment depicts an example of the laptop as the electronic apparatus 100, other embodiments are also possible. Accordingly, the electronic apparatus 100 may be a tablet, or a smart phone that includes only one casing (i.e., upper casing), in which case the speaker may be arranged in the upper casing.

The lower casing may include a plurality of speakers 160-1, 160-2, 160-3, 160-4 arranged therein. Meanwhile, in another exemplary embodiment, the electronic apparatus 100 may include only one speaker. Alternatively, considering that recent laptops or tablets can provide stereo sound using two speakers or 5.1 surround sound using six speakers, the electronic apparatus 100 may include two or more speakers. Meanwhile, when one of the plurality of speakers is a woofer speaker, the corresponding speaker may be fixedly arranged.

The speakers 160-1, 160-2 may be arranged at an upper area of the lower casing, while the speakers 160-3, 160-4 may be arranged at a lower area of the lower casing. Meanwhile, although the drawings do not specifically illustrate the left-side area of the lower casing, the left-side area of the lower casing may also include a speaker therein.

When the speaker is arranged at the upper area of the lower casing, the direction of outputting of the speaker corresponds to the direction of the ceiling (or upward) when the lower casing is flat on a horizontal surface. Accordingly, the direction of outputting of the speaker may be varied toward the user, using the manner explained above with reference to FIG. 4 or 6.

When the speaker is arranged at the left- or right-side area of the lower casing, the direction of outputting of the speaker corresponds to the rightward or leftward direction of the electronic apparatus. Accordingly, the direction of outputting of the speaker may be varied toward the user, according to the manner as explained above with reference to FIG. 5.

Meanwhile, in the embodiment explained with reference to FIG. 2, the electronic apparatus 100 may be a laptop, but is not limited thereto. Accordingly, the electronic apparatus 100 may be a tablet, or a smart phone that includes only one casing (i.e., upper casing), in which case the speaker may be arranged in the upper casing.

FIGS. 4 to 6 are views provided to explain various configurations of the speaker.

Referring to FIG. 4, the speaker 160' is arranged at an upper portion of the lower casing. That is, the speaker 160 is arranged to face in an upward direction when the lower casing is disposed on a horizontal surface, with an electromagnet arranged on a lower portion of the speaker 160'. The hinge 165 (see FIG. 3) of the speaker 160' is arranged at a front portion of and connected to the upper casing.

Accordingly, upon application of electric current on the electromagnet 140, due to an electromagnetic field of the electromagnet 140, a force of repulsion is applied to the permanent magnet and the hinge at the front end of the speaker 160' is the point where the speaker 160 pivots to project out of the upper portion of the lower casing. As a result, the rear end of the speaker projects upward. That is, the speaker 160 rotates with reference to the hinge. As the speaker 160' projects upward, the direction of outputting audio from the speaker 160' changes to be oriented toward the user.

Then when the electric current on the electromagnet 140 is cut off, the force of repulsion between the electromagnet 140 and the permanent magnet is stopped. As a result, the magnetic force of the permanent magnet causes force of attraction to be generated with the iron core of the electromagnet 140. Accordingly, the speaker 160' is rotated about the hinge to be changed back from the projected position to a buried position in the electronic apparatus 100. The speaker 160' is arranged parallel to the other upper plane of the lower casing when completely buried.

FIG. 5 depicts an example of a speaker 160" which is arranged at right or left side of the lower casing.

That is, the speaker 160" is arranged in a rightward direction of the lower casing, while the electromagnet 140 is arranged on the left-side circuit board 105 of the speaker 160". The hinge 165 of the speaker 160" is arranged on a front portion (towards the user) of the housing 161 to be connected to the lower casing.

Accordingly, with the application of electric current flowing to the electromagnet 140, the magnetic field of the electromagnet 140 causes a force of repulsion to be applied with the permanent magnet of the speaker 160", according to which the front end of the speaker 160" is fixed at the hinge, causing the rear end of the speaker 160" to project out. As a result, the speaker 160" rotates outward about the hinge. Since the speaker 160" projects in the manner as explained above, the direction of outputting of the speaker 160" is oriented toward user.

Then when the electric current flowing to the electromagnet 140 is cut off, the force of repulsion between the electromagnet 140 and the permanent magnet is stopped, so that a force of attraction is generated between the permanent magnet and the electromagnet 140 by the magnetism of the permanent magnet. Accordingly, the speaker 160" at the side portion of the lower casing is rotated about the hinge from the projected position to the buried position in the electronic apparatus 100.

Referring to FIG. 6, the speaker 160'" is arranged at an upper portion of a lower casing. That is, the speaker 160'" is arranged to face in an upward direction from the lower casing and the electromagnet 140 is arranged at the lower end of the speaker 160'". The housing of the speaker 160'" is slidably connected to the upper side of the lower casing.

As a result, with the application of an electric current to the electromagnet 140, the magnetic field of the electromagnet 140 causes a force of repulsion to be applied on the permanent magnet of the speaker, and as a result, the speaker 160'" is moved along the sliding line of the lower casing upwardly to a projected position. Since the speaker 160'" is projected at this point, the direction of outputting of the speaker 160" is oriented toward the user as illustrated by the grid lines indicating the front of the speaker 160'".

Then when the electric current flowing to the electromagnet 140 is cut off, the force of repulsion between the electromagnet 140 and the permanent magnet is stopped, so that a force of attraction is generated between the permanent magnet and the electromagnet 140 by the magnetism of the permanent magnet. Accordingly, the speaker 160'" is slid along the sliding line from the projected position back to the buried position.

FIG. 7 is a view provided to explain an example in which an electromagnet is provided in the circuit board.

Referring to FIG. 7, the circuit board 105 in this exemplary embodiment is a multi board PCB including a plurality of layers, and includes an electromagnet 140" in a circuit pattern on the multi board PCB. That is, the electromagnet 140" includes circular coil patterns 141 arranged in respective layers, and vias 142 that connect between the coil patterns 141 of the respective layers.

Accordingly, it is possible to implement the electromagnet 140" by simply using the patterns on the circuit board, without having to use a separate circuit device. The electromagnet 140" on the circuit board forms an upward or downward magnetic field on the board.

Figure 8:
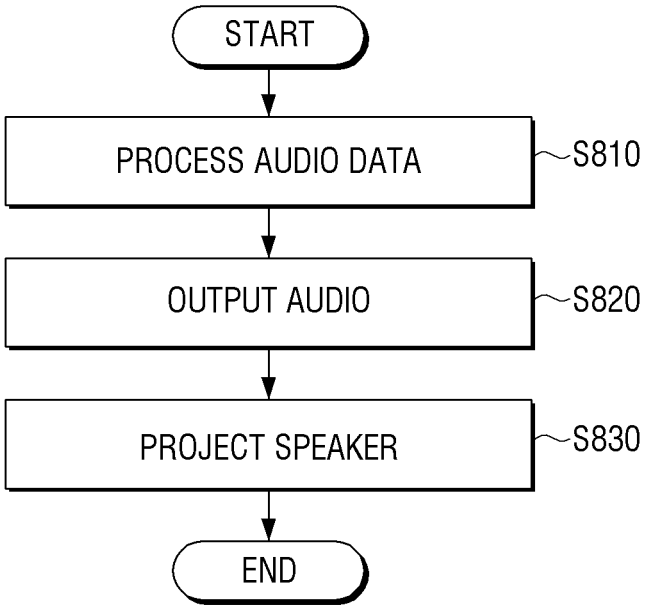
FIG. 8 is a flowchart provided to explain a sound providing method according to an embodiment.

FIG. 8 is a flowchart provided to explain a sound providing method according to an exemplary embodiment.

Referring to FIG. 8, at S810, audio data is processed. That is, the audio processing may be performed with respect to audio data received from an external device or an internally-stored music file.

At S820, the processed audio data is output to the speaker. Accordingly, the speaker outputs audio. Meanwhile, for an electronic apparatus having a plurality of speakers and sources of data with a plurality of channels such as stereo data, audio data of a specific channel may be transmitted to the corresponding speaker. For example, for stereo data, the left-side audio data may be output to the speaker which is on the left side of the electronic apparatus, while the right-side audio data is output to the speaker which is on the right side of the electronic apparatus.

At S830, the speaker is projected from the electronic apparatus. To be specific, using the electromagnet to push the permanent magnet of speaker with application of electric current, the speaker may be projected from the electronic apparatus. Such a projecting operation may be performed before the audio data processing explained above.

Accordingly, the sound outputting method in an embodiment may output user-oriented sound by varying the direction of outputting of the speaker. Further, since it is possible to vary the direction of outputting of the speaker, using only the small-sized electromagnet and without having to use a relatively large-sized component such as a motor, the size and cost of the system can be reduced. Further, when it is not necessary to output audio from the speaker, the speaker may be fixed at a position using a force of attraction between the iron core of the electromagnet and the permanent magnet of the speaker, without having to use additional equipment. The sound providing method as illustrated in FIG. 8 may be implemented on an electronic apparatus constructed in a manner illustrated in FIG. 1, or on any other electronic apparatus with different constitutions.

Further, the sound providing method according to embodiments may be implemented as a program (or application) including a computer-executable algorithm, and may be stored on a non-transitory computer readable medium for use.

The non-transitory computer-readable recording medium indicates a medium which can store data semi-permanently and can be read by devices, not a medium storing data temporarily such as a register, cache, or memory. Specifically, the above various applications or programs may be stored and provided in a non-transitory computer-readable recording medium such as a CD, DVD, hard disk, Blu-ray disk, USB, memory card, or ROM.

Figure 9:
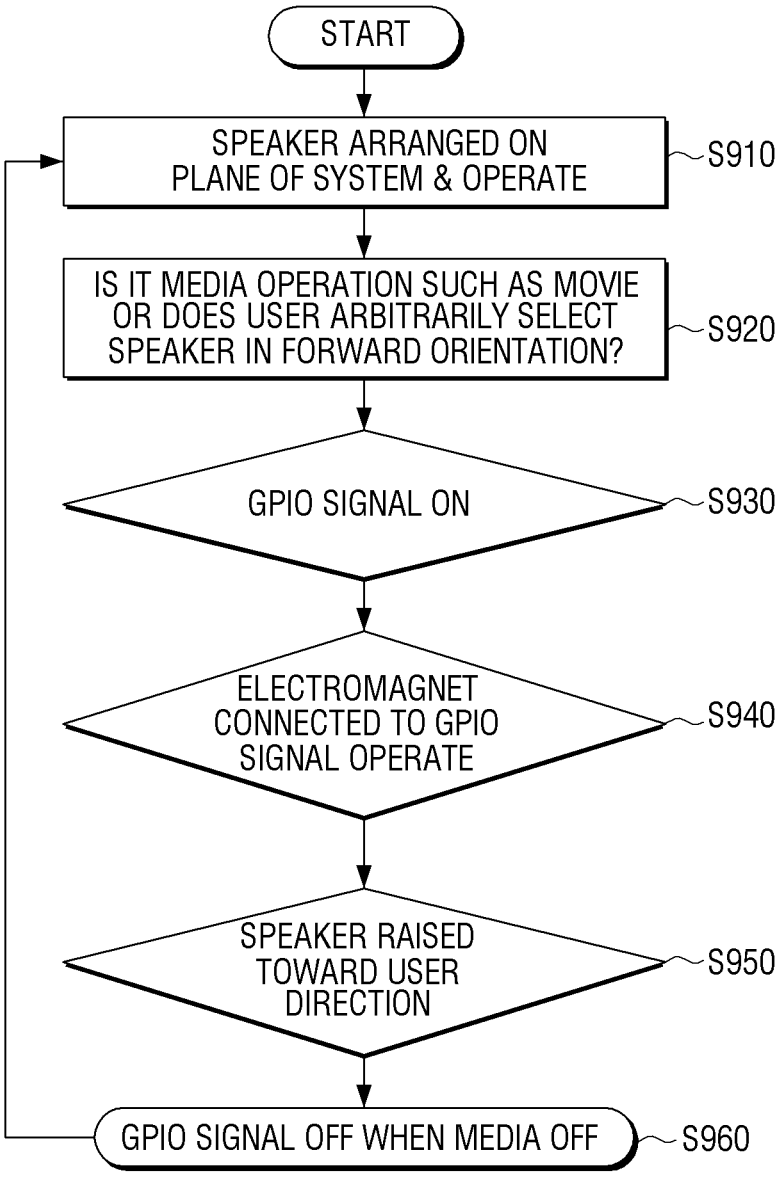
FIG. 9 is a flowchart provided to explain a projecting operation of FIG. 8 in detail.

FIG. 9 is a flowchart provided to explain a projecting operation of FIG. 8 in detail.

Referring to FIG. 9, at S910, the speaker is buried in the electronic apparatus 100. For the detailed arrangement, the explanation is referenced to the above description made with reference to FIGS. 3 to 6.

At S920, it is determined whether the speaker is to be projected. That is, when the user drives a playback command for contents such as a movie, or presses a preset button 121, it may be determined that the speaker has to be projected. The determination operation may be performed at a hardware level (e.g., microcomputer) and on a program.

When it is determined that the speaker is to be projected, at S930, electric current is input to the electromagnet. That is, a general microcomputer may perform electric current supply, or a devoted chipset may be provided for that purpose.

At S940, the electromagnet operates by the electric current supply, and at S950, a force of repulsion is generated between the magnetic force generated from the electromagnet and a magnetic force of the permanent magnet, and the speaker projects from the electronic apparatus 100 as a result.

At S960, when media playback is completed or when a preset button is input again, electric current supply to the electromagnet is cut off. As a result, the speaker is buried in the electronic apparatus.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An electronic apparatus comprising:

a speaker configured to output audio using a permanent magnet;

an audio processor configured to process audio data and output to the speaker; and an electromagnet configured to push the permanent magnet and to project the speaker out of the electronic apparatus by pushing the permanent magnet, with application of an electric current; and a controller to sense a position of a user, to determine a degree of the projection of the speaker based on the sensed position of the user, and to determine flow of the electric current through the electromagnet based on the determined degree of the projection of the speaker.

2. The electronic apparatus of claim 1, wherein the speaker comprises:

a housing in which one side is connected to the electronic apparatus with a hinge, and another side extends to a distance from the electronic apparatus; and a speaker module arranged within the housing to output the audio using the permanent magnet.

3. The electronic apparatus of claim 2, wherein the housing is buried in the electronic apparatus to an extent of being in a parallel relationship with a surface of the electronic apparatus, when the electric current is not input to the electromagnet.

4. The electronic apparatus of claim 1, wherein the electromagnet is arranged at a position on a circuit board to correspond to the permanent magnet.

5. The electronic apparatus of claim 4, wherein the electromagnet comprises one of a solenoid and a superconductive magnet.

6. The electronic apparatus of claim 4, wherein the circuit board comprises a plurality of layers, and the electromagnet comprises a coil pattern of a plurality of layers on the circuit board.

7. The electronic apparatus of claim 1, wherein the electromagnet comprises an iron core, and wherein the speaker is buried within the electronic apparatus when the electric current is not input to the electromagnet, as the permanent magnet pulls the iron core.

8. The electronic apparatus of claim 1, further comprising a plurality of speakers and a plurality of electromagnets corresponding to the plurality of speakers, respectively, and wherein the audio processor outputs the audio data to the plurality of speakers.

9. The electronic apparatus of claim 8, further comprising a controller configured to individually control whether the plurality of electromagnets is operated.

10. The electronic apparatus of claim 1, further comprising a controller configured to control whether the electromagnet is operated.

11. The electronic apparatus of claim 10, wherein the controller is configured to control the electromagnet operate upon receiving of one or more of a control command from a user and a preset program.

12. The electronic apparatus of claim 10, wherein the controller projects the speaker to a predetermined height by allowing the electric current in an amount corresponding to a user set value and a preset condition to flow on the electromagnet.

13. A method of providing sound in an electronic apparatus comprising at least one speaker, the sound providing method comprising:

processing audio data;

outputting the processed audio data to the at least one speaker;

sensing a position of a user;

determining a degree of projection of the at least one speaker based on the sensed position of the user;

determining an electric current which flows through an electromagnet based on the determination of the degree of projection of the at least one speaker; and projecting the at least one speaker out on the electronic apparatus, using the electromagnet to push a permanent magnet of the speaker upon application of the current.

14. The method of claim 13, further comprising:

pulling, by the permanent magnet, an iron core to bury the speaker within the electronic apparatus, in an absence of the electric current on the electromagnet.

15. The method of claim 13, wherein the electronic apparatus comprises a plurality of speakers and a plurality of electromagnets corresponding to the plurality of speakers, respectively, and the outputting of the processed audio data comprises outputting the audio data to the plurality of speakers.

16. The method of claim 15, wherein the projecting of the at least one speaker comprises individually controlling the plurality of electromagnets, and individually projecting the plurality of speakers, respectively.

17. The method of claim 13, wherein the projecting of the at least one speaker comprises projecting the at least one speaker out of the electronic apparatus based on one or more of a user control command and a preset program.

18. The method of claim 13, wherein the projecting of the at least one speaker comprises projecting the at least one speaker to a preset height, by allowing the electric current to flow to the electromagnet in an amount corresponding to a user set value and a preset condition.

19. An electronic apparatus with a casing, comprising:

at least one speaker including a permanent magnet and configured to move between being disposed within the casing and projecting from the casing;

an electromagnet disposed within the casing and configured to create a repulsive force with the permanent magnet to force the speaker to project from the casing when an electric current is applied thereto; and, a controller to sense a position of a user, to determine a degree of projection of the at least one speaker based on the sensed position of the user, and to determine the electric current which flows through the electromagnet based on the determination of the degree of projection of the at least one speaker.

* * * * *